US006259764B1

(12) United States Patent
Evans-Lutterodt et al.

(10) Patent No.: US 6,259,764 B1
(45) Date of Patent: Jul. 10, 2001

(54) ZONE PLATES FOR X-RAYS

(75) Inventors: Kenneth Evans-Lutterodt, Bridgewater, NJ (US); Chang-Yong Kim, Upton, NY (US)

(73) Assignee: Agere Systems Guardian Corp., Miami Lakes, FL (US)

( * ) Notice: Subject to any disclaimer, the term of this patent is extended or adjusted under 35 U.S.C. 154(b) by 0 days.

(21) Appl. No.: 09/356,396

(22) Filed: Jul. 16, 1999

(51) Int. Cl.[7] ..... G21K 1/06
(52) U.S. Cl. ..... 378/84; 378/85; 378/34
(58) Field of Search ..... 378/84, 85, 70, 378/34, 35

(56) References Cited

U.S. PATENT DOCUMENTS 5,272,744 * 12/1993 Itou et al. ..... 378/35
5,719,915 * 2/1998 Koike et al. ..... 378/84
6,128,364 * 10/2000 Niemann ..... 378/43

OTHER PUBLICATIONS

"Microfocusing Optics for Hard X–Rays Fabricated by X–Ray Lithography" by A.A. Krasnoperova et al, SPIE vol. 2516, pp. 15–26.

* cited by examiner

*Primary Examiner*—David P. Porta
*Assistant Examiner*—Drew A. Dunn

(57) ABSTRACT

An amplitude-type Fresnel zone plate for focusing incident X-rays is formed in a single-crystal layer. For incident X-rays that are above a threshold energy level and that are directed at the zone plate at a specified angle, Bragg reflection occurs from crystallographic planes within the elements of the zone plate even when the layer is exceedingly thin. Accordingly, zone plates with extremely narrow elements may be fabricated. In turn, this allows the realization of zone plates capable of focusing X-rays to very small spot sizes.

14 Claims, 3 Drawing Sheets

ZONE PLATES FOR X-RAYS

TECHNICAL FIELD

This invention relates to the focusing of X-rays and. more particularly, to the utilization of microminiature periodic structures for focusing hard X-rays.

BACKGROUND OF THE INVENTION

In a number of applications of practical importance, it is necessary to be able to focus rays emanating from an X-ray source into a small spot size. For so-called hard or relatively high-energy X-rays, this is a particularly difficult and challenging task. Various techniques for fabricating optical elements capable of focusing hard X-rays are described in a paper entitled "Microfocusing Optics for Hard X-Rays Fabricated by X-Ray Lithography" by A. A. Krasnoperova et al, SPIE Proc., vol. 2516, pages 15–26, 1995.

In particular, a number of structures made by integrated-circuit fabrication processes and suitable for focusing hard X-rays have been priorly proposed. Among these are a variety of periodic structures including Fresnel zone plates.

Heretofore, Fresnel zone plates for hard X-rays have been formed in a layer whose thickness is specified by a particular phase-shift requirement. In practice, the thickness of such a layer from which phase-type zone plates are fabricated has typically been at least about several micrometers ($\mu$m).

To achieve an extremely small or high-resolution spot size with a Fresnel zone plate onto which X-rays of a specified energy impinge, the smallest feature of the zone plate structure must have a width that is comparable in size to the desired spot size. Thus, for example, if the features of the zone plate are formed in a three-$\mu$m-thick layer and an aspect ratio (thickness-to-width dimensions) of about ten is manufacturable, the smallest feature that can be defined in the zone plate structure is approximately 0.3 $\mu$m [or about 300 nanometers (nm)]. In that case, the zone plate is capable of focusing the specified hard X-rays to a spot size having a diameter of the order of 300 nm. But, as the energy of the incident X-rays increases, i.e. for harder X-rays, the required thickness of the zone plate increases in order to ensure the correct phase shift between adjacent zones. Given the same manufacturable aspect ratio, this results in thicker zone plates with larger feature sizes and hence larger spot sizes.

Accordingly, efforts have continued by workers skilled in the art directed at trying to devise improved structures suitable for focusing hard X-rays to a small spot size. It was recognized that such efforts, if successful, would provide an important instrumentality for use in various practical applications such as in non-destructively examining small features in integrated circuits.

SUMMARY OF THE INVENTION

In accordance with the principles of the present invention, a layer of a single-crystal material is formed on a substrate made of a substance that does not satisfy the Bragg condition for reflection when the layer of single-crystal material does. The substrate can even be of single-crystal material; the only requirement is that the substrate and the thin single-crystal layer do not simultaneously satisfy the Bragg condition.

In particular, in accordance with the invention, the single-crystal layer is patterned to define a periodic structure such as a multi-element amplitude-type Fresnel zone plate. In the periodic structure, selected portions of the single-crystal layer are totally removed to reveal the underlying substrate. A portion of the incident X-rays above a threshold energy level and directed at the zone plate at a specified angle is reflected from the elements of the zone plate. Specifically, the reflected rays constructively converge to form a focused spot.

In further accordance with the invention, the width of the narrowest element of such an amplitude-type zone plate, and thus the size of the focused spot, may be decreased while maintaining an achievable aspect ratio simply by decreasing the thickness of the single-crystal layer. Correspondingly, as the thickness of the single-crystal layer decreases, the intensity of the focused spot also decreases.

BRIEF DESCRIPTION OF THE DRAWING

A complete understanding of the present invention and of the above and other features and advantages thereof may be gained from a consideration of the following detailed description presented hereinbelow in connection with the accompanying drawing, not drawn to scale, in which.

DETAILED DESCRIPTION

Figure 1:
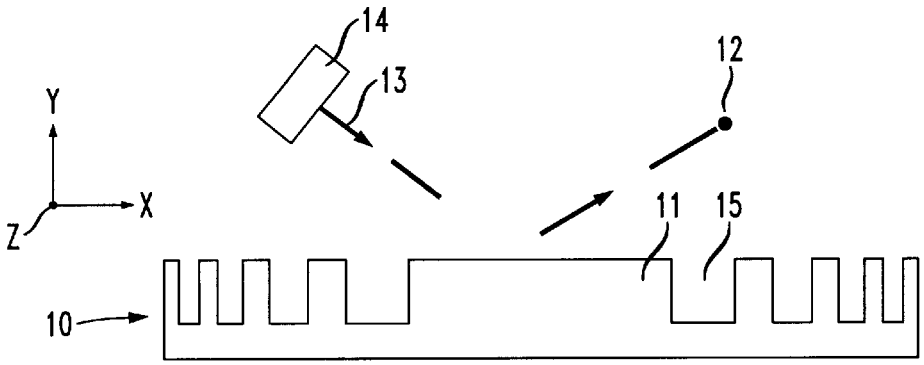
FIG. 1 PRIOR ART
FIG. 1 is simplified schematic depiction of a conventional phase-type Fresnel zone plate utilized to focus incident X-rays to a spot.

FIG. 1 is a schematic side view of a conventional Bragg-Fresnel phasetype zone plate element 10 designed to focus incident X-rays to form a spot 12. In the particular arrangement shown in FIG. 1, X-rays from a source 14 are directed at an off-normal angle in the direction of arrow 13 toward the element 10. In turn. incident X-rays so directed are reflected by the element 10 and converge to form the spot 12.

In a conventional illustrative arrangement of the type represented in FIG. 1, a layer comprising a single-crystal is patterned to form the elements of a zone plate. The zone plate so formed may be either of the circular or linear type, as is well known. Herein, for the purpose of providing a specific illustrative example, the zone plate to be specified in detail will be considered to be of the circular type.

More specifically, in a typical phase-type zone plate of the type depicted in FIG. 1, the zone plate is formed by thinning alternate elements defined in the original single-crystal layer. Thus, for example, one element 11 is defined by an unthinned portion of the original layer. This unthinned portion has a specified X-direction width. And the next adjacent element 15 of the zone plate is defined by a portion of the original layer having a different width and a prescribed finite Y-direction thickness that is less than that of the first-mentioned element. In particular, the Y-direction thickness differences between adjacent elements are selected to impart a prescribed phase difference to X-rays respectively reflected from the adjacent elements. Specifically, the phase difference is chosen such that rays reflected from adjacent elements constructively converge at the spot 12. In practice, for so-called hard X-rays [X-rays having energies above about two kilo-electron-Volts (keV)], the Y-direction thickness of the original layer in known zone plates is typically at least approximately three $\mu$m.

By way of example, the conventional phase-type zone plate represented in FIG. 1 comprises a patterned single-crystal wafer of germanium. One particular illustrative way in which to pattern the wafer to form a circular phase-type Fresnel zone plate is depicted in simplified form in FIG. 2, which is a top view of the FIG. 1 structure.

Figure 2:
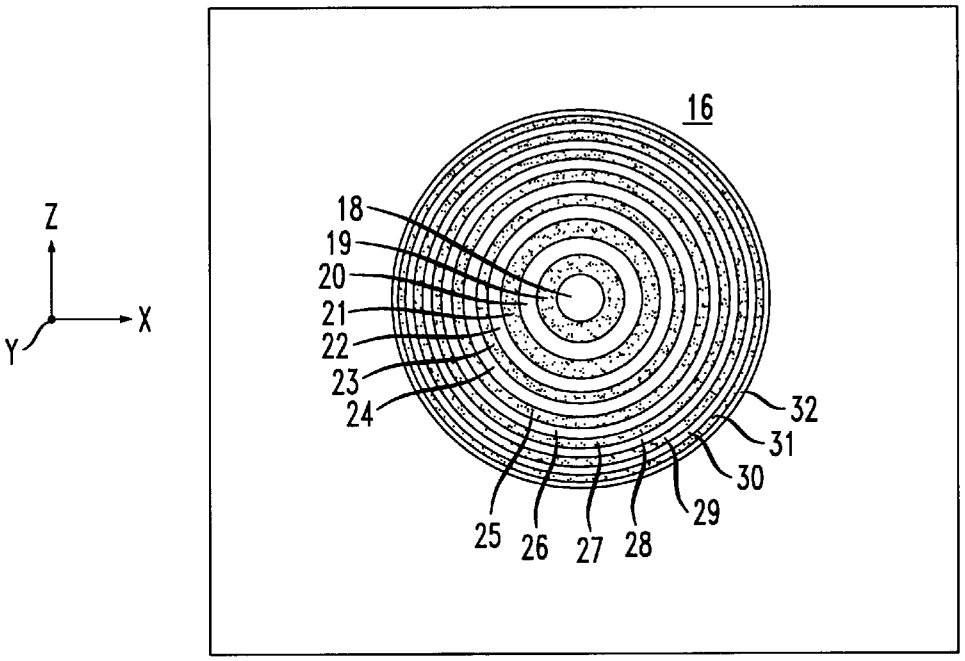
FIG. 2 PRIOR ART
FIG. 2 is a representative showing of a conventional circular zone plate structure.

An individual phase-type zone plate 16 capable of focusing X-rays is represented in FIG. 2. The known depicted structure comprises an inner circle 18 surrounded by a set of concentric rings 19 through 32. By way of example, a first set of elements including the inner circle 18 and the rings 20, 22, 24, 26, 28, 30 and 32 of FIG. 2 comprise regions whose Y-direction thickness is the same as that of the original unpatterned wafer. On the other hand, a second set of elements including the rings 19, 21, 23, 25, 27, 29 and 31 are designed to each have a Y-direction thickness that is greater than zero but less than that of the original wafer. As is well known, the relative thicknesses of the two sets of X-ray-reflecting elements are selected to achieve a prescribed phase condition necessary for forming the focused spot 12 (FIG. 1).

Alternatively, the relative thicknesses of the first and second sets of elements shown in FIG. 2 may be respectively reversed. Either arrangement is known to be effective to function as a phase-type Fresnel zone plate.

As is well known, a circular zone plate such as the illustrative one depicted in FIG. 2 is defined by a set of concentric circles whose radii are proportional to the square roots of whole numbers. More specifically, the radius $r_n$ of the $n^{th}$ half-wave zone of a circular Fresnel zone plate is related to the source distance a and the image distance b by $$n\lambda/2=r^2n/2(1/a+1/b)n \quad (1)$$

where $\lambda$ is the wavelength of the X-rays that are directed at the zone plate. Writing equation (1) in the form $$1/a+1/b=n\lambda r^2n=1/f \quad (2)$$

it is evident that in the paraxial limit such a plate functions in effect as a lens with a focal length $$f=r^2n/n\lambda=r_1^2/\lambda \quad (3).$$

Thus, for an incident X-ray beam of known wavelength, a desired focal length may be established simply by selecting the radius of the innermost circle (for example, the circle 18 in FIG. 2) to satisfy the expression for f given above. And the radii $r_2$, $r_3$ . . . $r_n$ of the other successively numbered and larger circles included in the pattern 16 of FIG. 2 are defined approximately by the relationship $r_n=n^{1/2}r_1$.

In a known phase-type zone plate of the type represented in FIGS. 1 and 2, the Y-direction thickness of the unpatterned wafer is in practice typically at least about three $\mu$m. In that case, assuming that rings having an aspect ratio of ten are manufacturable, the outermost ring 32 can be made to have an X-direction width in the order of about 0.3 $\mu$m (300 nm). And, since as previously indicated the minimum width of the outermost ring determines approximately the minimum diameter of the focused spot 12 (FIG. 1), such a priorly known zone plate is capable of focusing incident X-rays to a spot having a diameter of at the smallest about 300 nm.

In accordance with the principles of the present invention, a Fresnel zone plate of the general type represented in FIG. 2 is modified in several unique and unobvious ways. First, a layer made of a material in single-crystal form is deposited on a substrate. And secondly the zone plate is designed to be an amplitude-type rather than a phase-type structure. By making these changes, it was discovered that hard X-rays above a minimum energy level and directed at the modified zone plate at a critical angle, could be focused. Moreover, it was found that the focusing action still occurs (albeit at a reduced intensity) when the single-crystal layer is thinned. In that way, by utilizing an extremely thin single-crystal layer, a very narrow outermost zone plate ring can be fabricated. Consequently, an extremely small-diameter focused spot can be thereby realized. Such a small spot is advantageous for, for example, high-resolution nondestructive scanning and inspection of internal features of microminiature integrated circuits.

Figure 3:
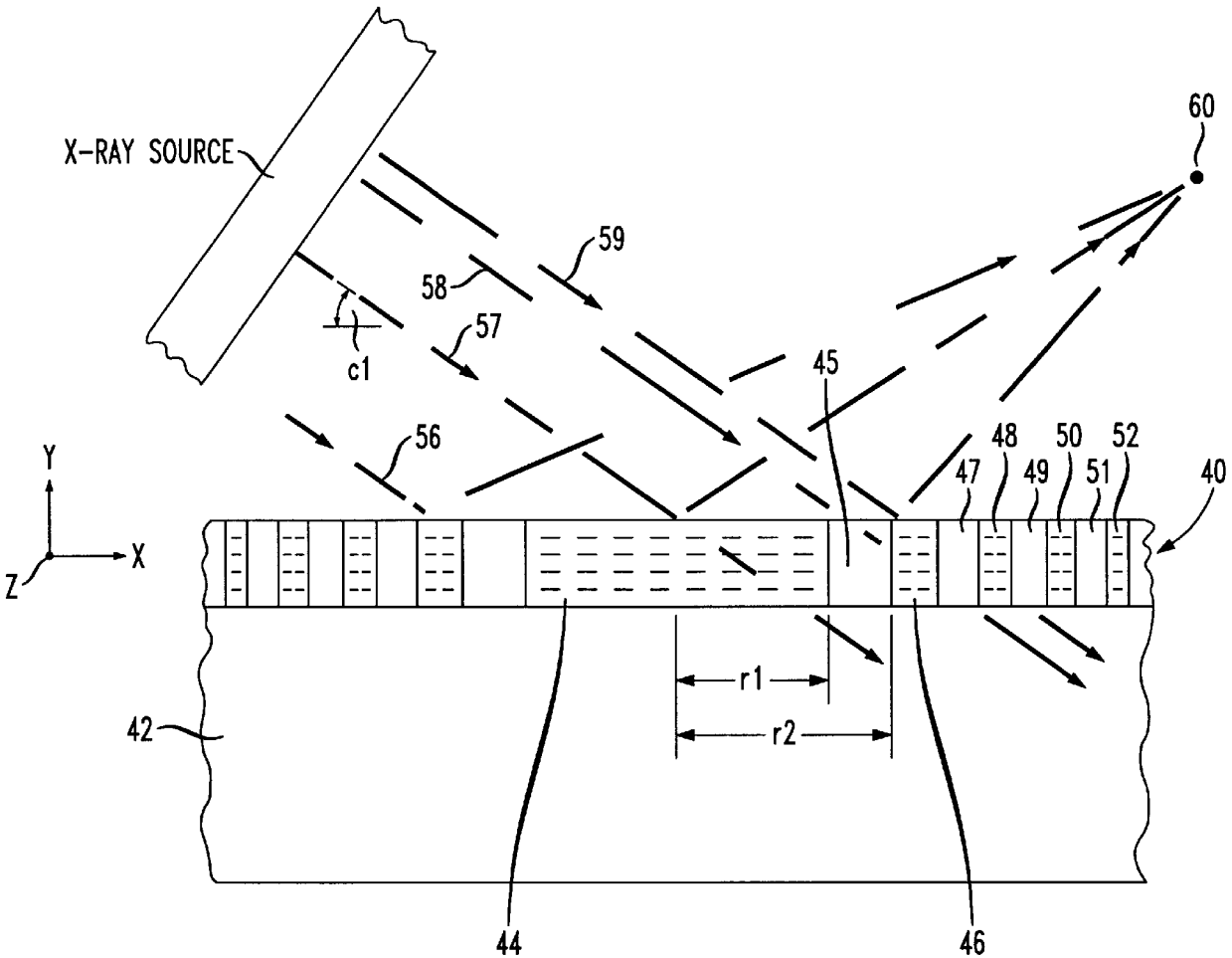
FIG. 3 shows a portion of a specific illustrative reflective amplitude-type zone plate structure made in accordance with the principles of the present invention.

FIG. 3 shows in simplified form a portion of one specific illustrative embodiment of the principles of the present invention. The schematically depicted embodiment constitutes a circular Fresnel zone plate defined in a layer 40. In accordance with the invention, the layer 40 comprises a single-crystal material. Illustrative materials from which to form the single-crystal layer 40 include silicon, germanium, indium phosphide, indium antimonide and tungsten. Any single-crystal material containing crystallographic planes capable of interacting with incident X-rays to provide Bragg reflection of the rays is suitable. Herein, for purposes of a particular illustrative example, the layer 40 will be assumed to be made of single-crystal silicon.

Further, the layer 40 of FIG. 3 is assumed, for example, to have a Y-direction thickness of about 200 nm. Additionally, the layer 40 is shown as being deposited or otherwise formed on a substrate 42. The substrate 42 is advantageously made of a material that is transmissive to or absorptive of incident X-rays. Suitable materials from which to make the substrate 42 include, for example, glass, quartz and polycrystalline silicon. Herein, for illustrative purposes, the substrate 42 will be assumed to be made of quartz, which is highly transmissive to incident X-rays.

In accordance with the present invention, the layer 40 of FIG. 3 is patterned to form a so-called amplitude-type zone plate structure. Each ring of the resulting structure comprises either the full Y-direction thickness of the layer 40 or no thickness at all. (This is unlike a phase-type zone plate in which each ring comprises some finite thickness of the original layer.)

By way of example, the amplitude-type Fresnel zone plate shown in FIG. 3 includes a central circular portion 44 whose Y-direction thickness is the same as that of the originally formed layer 40. In turn, the first ring 45 surrounding the central portion 44 constitutes a region in which the material of the layer 40 is totally removed. And the next ring 46 comprises a full-thickness region, and so forth.

By alternating full-thickness and clear regions, the layer 40 of FIG. 3 is patterned to form an amplitude-type Fresnel zone plate. The respective X-direction widths of the multiple rings that constitute the depicted zone plate are determined in accordance with the same relationships specified earlier above in connection with the description of FIG. 2. In addition to the already specified elements 44 through 46, only six others of these multiple rings of the zone plate structure are explicitly shown in FIG. 3, where these additional rings are repectively designated by reference numerals 47 through 52.

X-rays incident on the zone plate shown in FIG. 3 are represented by dash lines 56 through 59. Portions of these incident rays are reflected by the elements of the depicted zone plate and constructively converge to form a focused spot 60. In one specific illustrative embodiment described in more particular detail later below, the overall X-direction diameter of the amplitude-type zone plate formed in the layer 40 of FIG. 3 is about 100 $\mu$m.

In practice, if the X-ray source represented in FIG. 3 is relatively small and far away from the surface of the patterned layer 40, the X-rays incident on the depicted zone plate may be considered to constitute a plane wave. Illustratively, for an X-ray source having a diameter of approximately ten $\mu$m and located about ten meters away from the zone plate, the approximately parallel rays emanating from such a source can be shown to exhibit a transverse coherence length that is greater than the overall diameter of the zone plate shown in FIG. 3.

In accordance with the principles of the present invention, reflection of incident X-rays from the amplitude-type zone plate represented in FIG. 3 occurs if several conditions are met. First, the energy of the incident X-rays must be above a specified threshold level. And, second, the incident X-rays must be directed at the surface of the zone plate at a prescribed angle c1. If these conditions are met, some of the incident rays interact with crystallographic planes in the single-crystal material of the zone plate structure and undergo Bragg reflection from those planes. (In FIG. 3, horizontal dash lines in each of the depicted full-thickness elements of the zone plate symbolically represent these crystallographic planes.) In turn, the Bragg-reflected rays are directed by the zone plate to converge to form the focused spot 60 (FIG. 3).

Some of the incident X-rays shown in FIG. 3 impinge on clear portions of the substrate 42 and, assuming that the substrate is made of an X-ray-transmissive material such as quartz, propagate through the substrate. Additionally, depending on the thickness of the depicted zone plate elements, even some of the incident rays that impinge on fill-thickness single-crystal elements of the zone plate (such as the elements 44, 46, 48, 50, 52 . . . ) may not be reflected therefrom. As the Y-direction thickness of the zone plate elements is decreased, less of the incident X-ray energy is rejected therefrom, which means that the intensity or brightness of the focused spot 60 correspondingly decreases.

In any case, some of the incident X-rays are reflected from the fullthickness elements of the zone plate shown in FIG. 3. On the other hand, rays that impinge upon elements that constitute cleared regions of the depicted zone plate are not reflected therefrom. Such a reflection/no-reflection structure is referred to herein as an amplitude-type zone plate. This is in contrast to a conventional phase-type zone plate in which some reflection of incident rays occurs from every element of the structure.

In one specific illustrative embodiment of the principles of the present invention, the layer 40 shown in FIG. 3 comprises single-crystal silicon, having a Y-direction thickness of about 200 nm, deposited on a substrate 42 made of quartz. Further, assume that the layer 40 is patterned as represented in FIG. 3 to form an amplitude-type Fresnel zone plate. In response to incident X-rays whose energy is about 8.04 keV and which are directed at the zone plate structure at an angle c1 of approximately 34.55 degrees, the structure of FIG. 3 reflects some of the incident X-rays and thereby forms the focused spot 60.

In a particular illustrative example of the FIG. 3 arrangement in which the desired focal length is one meter, the radius $r_1$ of the circular region 44 of FIG. 3 is thereby specified to be ten $\mu$m. And, as indicated earlier above, the radii $r_2$, $r_3$ . . . $r_n$ of the other successively numbered and larger circles included in the zone plate pattern of FIG. 3 are approximately established by the relationship $r_n=n^{1/2}\ r_1$. For the specific case in which the Y-direction thickness of the layer 40 is 200 nm and an aspect ratio of about ten is manufacturable, the outermost ring of the FIG. 3 zone plate would be the 2,500th ring of the zone plate and would have an X-direction width of about 20 nm. Such a specific illustrative structure is capable of providing a focused spot having a diameter of about 20 nm.

By further decreasing the Y-direction thickness of the layer 40 shown in FIG. 3, it is feasible to fabricate a reflective zone plate structure in which the X-direction width of the outermost ring is correspondingly further decreased. In that way, even smaller-diameter focused spots are achievable. Of course, less of the incident X-ray energy is reflected as the thickness of the zone plate is reduced, whereby the intensity of the focused spot 60 is thereby reduced.

For each different single-crystal material in which the amplitude-type zone plate structure of FIG. 3 is defined, Bragg reflection of incident X-rays will occur above a threshold energy level and at a specified angle of incidence. By meeting these criteria for each different material from which the single-crystal layer 40 is made, some of the incident rays are reflected from Bragg planes of the material. In turn, the rays so reflected from the respective multiple elements of the zone plate constructively converge at a specified focal point to provide a focused X-ray spot. (For X-ray energies above the threshold value, focusing still occurs. But, as the incident energy increases, the relative intensity of the focused spot decreases.)

FIG. 3 shows a reflective amplitude-type zone plate structure made in accordance with the principles of the present invention. Alternatively, it is feasible to make another embodiment of the invention that constitutes a transmissive amplitude-type zone plate structure. A specific illustrative example of the latter form of structure is represented in FIG. 4.

Figure 4:
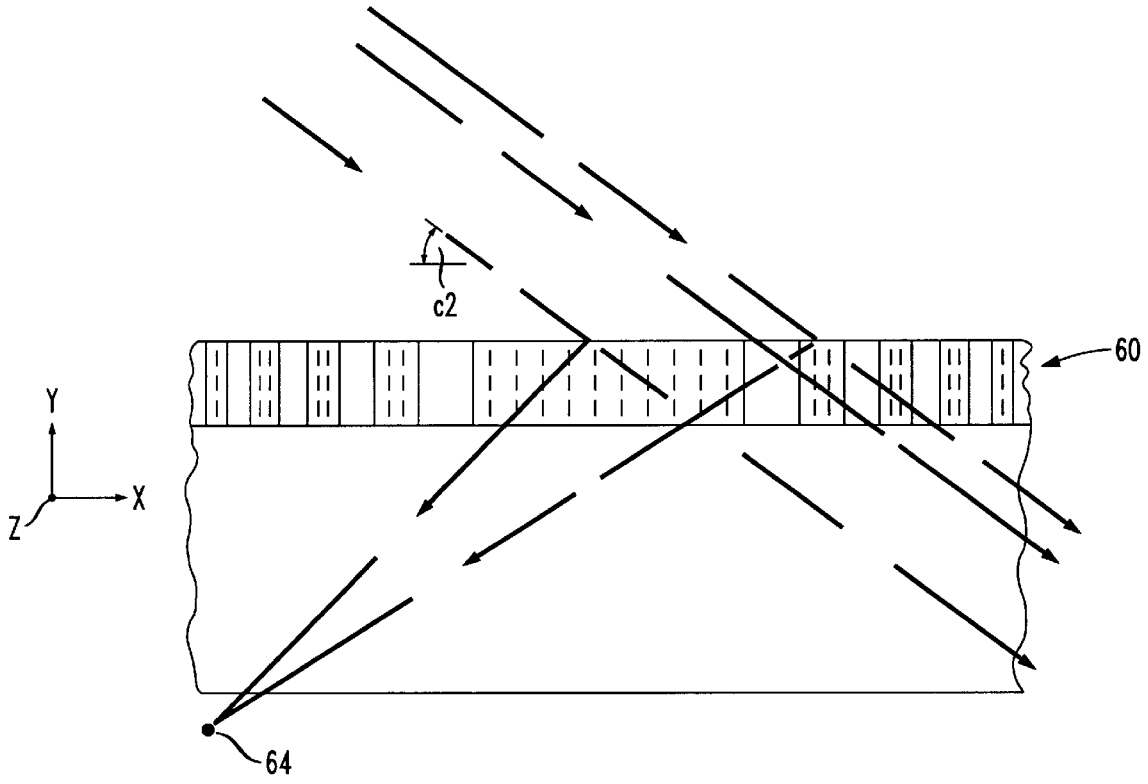
FIG. 4 depicts a portion of a specific illustrative transmissive amplitudetype zone plate structure made in accordance with the principles of the present invention.

Structurally, the zone plate portion of the FIG. 4 arrangement may be identical to the corresponding portion shown in FIG. 3. Thus, FIG. 4 also shows an amplitude-type zone plate structure formed in a single-crystal layer 60. But, by directing X-rays of at least a particular energy level at the FIG. 4 zone plate at a prescribed angle c2, it is feasible to cause an interaction between the incident rays and vertically (rather than horizontally) disposed Bragg planes in single-crystal elements of the zone plate. These interactions or Bragg reflections cause some of the incident rays to propagate through the zone plate elements and to converge to form a focused spot 64, as schematically represented in FIG. 4.

Thus, for example, assume that the layer 60 of FIG. 4 is again made of single-crystal silicon. In that case, the depicted Bragg reflection from the vertically oriented crystalline planes will occur if the energy of the incident X-rays is about 8.04 keV and if the indicated angle c2 is 55.45 degrees.

In further accord with the invention, arrays of amplitude-type zone plates may be batch-fabricated in a single-crystal layer. A schematic representation of a typical such array of zone plates is shown in FIG. 5.

Figure 5:
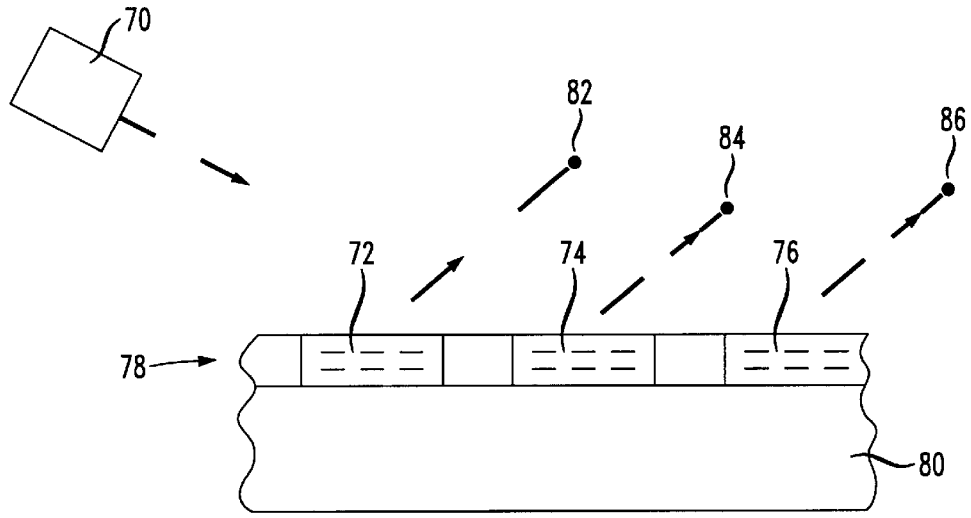
FIG. 5 schematically shows in simplified form an array of the structures depicted in FIG. 3 or FIG. 4.

In FIG. 5, an X-ray source 70 illuminates plural amplitude-type zone plates 72, 74 and 76 that are defined in a single-crystal layer 78 that is formed on a substrate 80. Illustratively, by way of a specific example, each of the zone plates 72, 74 and 76 is of the circular reflective type described above. Thus, in response to incident X-rays that are above a prescribed energy level and that are directed at the zone plate array at a predetermined angle, the several zone plates 72, 74 and 76 respond to the X-rays by providing several focused spots 82, 84 and 86, respectively. In that way, several different regions of a sample to be examined by X-ray scanning may be simultaneously probed by the indicated spots.

Finally, it is to be understood that the various above-described arrangements are only illustrative of the application of the principles of the present invention. In accordance with these principles, numerous other arrangements may be devised by those skilled in the art without departing from the spirit and scope of the present invention. Thus, for example, although emphasis herein has been directed to circular amplitude-type zone plates, it is apparent that other periodic amplitude-type structures such as linear zone plates formed in a single-crystal layer and capable of focusing X-rays are within the scope of the present invention.

What is claimed is:

1. An assembly for focusing X-rays that emanate from a source that provides X-rays of at least a specified energy at a prescribed angle with respect to said assembly, said assembly comprising a substrate that is non-reflective of incident X-rays from said source at the prescribed angle, a single-crystal layer on said substrate, said layer having a prescribed thickness and being characterized by parallel-disposed crystallographic planes, and a periodic structure formed in said single-crystal layer, said structure including interleaved first and second sets of elements, said first set of elements comprising spaced-apart regions of said layer each having a different width and each having the full thickness of said layer, and said second set of elements comprising spaced-apart cleared regions of said layer, each of said second set of elements having a different width, whereby X-rays directed at said prescribed angle at said assembly including said first and second sets of elements are Bragg reflected only from said parallel-disposed crystallographic planes of said first set of elements and constructively converge to form a focused X-ray spot.

2. An assembly as in claim 1 wherein said periodic structure comprises a Fresnel zone plate.

3. Apparatus for forming a focused X-ray spot comprising a substrate made of a material that is non-reflective to X-rays, said substrate having a planar top surface, a layer of single-crystal material on the surface of said substrate, said layer having a prescribed thickness and being characterized by parallel-disposed crystallographic planes, a multi-element amplitude-type periodic structure formed in said layer, said structure comprising interleaved first and second sets of elements, said first set of elements each having a different width and having a thickness equal to said prescribed thickness and each having parallel-disposed crystallographic planes, and said second set of elements each having a different width and each constituting a cleared zero-thickness portion of said layer, and a source for directing incident X-rays that have at least a specified minimum energy at said structure at a predetermined angle to cause Bragg reflection to occur from the crystallographic planes of said first set of elements, thereby to focus some of the incident X-rays to form an X-ray spot.

4. Apparatus as in claim 3 wherein said periodic structure comprises a Fresnel zone plate.

5. Apparatus as in claim 4 wherein said Fresnel zone plate is of the circular type.

6. Apparatus as in claim 5 wherein the energy and angle of incidence of said X-rays are selected to cause Bragg reflection from crystallographic planes of said structure that are parallel to the top surface of said substrate.

7. Apparatus as in claim 5 wherein the energy and angle of incidence of said X-rays are selected to cause Bragg reflection from crystallographic planes of said structure that are normal to the top surface of said substrate.

8. Apparatus as in claim 3 wherein an array of said periodic structures is formed in said layer.

9. Apparatus as in claim 3 wherein said layer comprises single-crystal silicon.

10. Apparatus as in claim 9 wherein the energy of X-rays directed at said structure is at least two keV.

11. Apparatus as in claim 10 wherein said X-rays are directed at said structure at an angle of 34.55 degrees with respect to said top surface.

12. Apparatus as in claim 11 wherein the thickness of said silicon layer is approximately 200 nm.

13. Apparatus as in claim 12 wherein the width of the narrowest one of said first and second sets of elements is about 20 nm.

14. Apparatus as in claim 13 wherein the diameter of the focused spot thereby formed is approximately 20 nm.

* * * * *